US007051898B1

(12) United States Patent
Connell

(10) Patent No.: US 7,051,898 B1
(45) Date of Patent: May 30, 2006

(54) BLISTER PACK RUPTURING DEVICE

(76) Inventor: Gerard P. Connell, 96 Hillside Dr., Plymouth, MA (US) 02360

( * ) Notice: Subject to any disclaimer, the term of this patent is extended or adjusted under 35 U.S.C. 154(b) by 46 days.

(21) Appl. No.: 10/945,474

(22) Filed: Sep. 20, 2004

(51) Int. Cl.
*G07F 11/72* (2006.01)

(52) U.S. Cl. ..... 221/30; 221/25

(58) Field of Classification Search ..... 221/30, 221/31, 28, 25, 87, 88, 131, 74; 205/104; 30/363, 364, 360; D19/72; 83/667, 374, 83/438, 451
See application file for complete search history.

(56) References Cited

U.S. PATENT DOCUMENTS 4,905,866 A 3/1990 Bartell et al. ..... 221/5
5,348,158 A * 9/1994 Honan et al. ..... 206/531
5,464,118 A 11/1995 Grau et al. ..... 221/5
5,791,513 A * 8/1998 Intini ..... 221/30
5,853,101 A 12/1998 Weinstein ..... 220/284
6,000,139 A 12/1999 Chan ..... 30/358
6,155,424 A 12/2000 Dubach ..... 206/531
6,540,081 B1 4/2003 Balz et al. ..... 206/531
6,557,740 B1 * 5/2003 Dent ..... 225/104

* cited by examiner

*Primary Examiner*—Patrick Mackey
*Assistant Examiner*—Timothy Waggoner
(74) *Attorney, Agent, or Firm*—Sturm & Fix LLP

(57) ABSTRACT

A device (10) for releasing a pill (101) from a blister pack (100) wherein, the device (10) includes a generally E-shaped housing member (20) having an upper tier (21) and an intermediate tier (22) provided with aligned apertures (25) (26) and a lower tier (23) provided with a transverse recess (27) wherein, the apertures (25) (26) are dimensioned to receive the shaft (31) of a plunger member (30) that will release the pill (101) into a trough member (40) through the aperture (26).

12 Claims, 2 Drawing Sheets

BLISTER PACK RUPTURING DEVICE

CROSS REFERENCE TO RELATED APPLICATIONS

Not applicable.

BACKGROUND OF THE INVENTION

1. Field of the Invention

The present invention relates to the field of blister pack rupturing devices in general and in particular to an improved delivery arrangement for a released pill.

2. Description of Related Art

As can be seen by reference to the following U.S. Pat. Nos. 6,000,139; 6,557,740; 5,791,513; 5,464,118; and, 5,348,158, the prior art is replete with myriad and diverse blister pack rupturing arrangements used to liberate pills from blister packaging.

While all of the aforementioned prior art constructions are more than adequate for the basic purpose and function for which they have been specifically designed, they are uniformly deficient with respect to their failure to provide a simple, efficient, and practical blister pack rupturing device with an improved pill delivery arrangement for depositing a freed pill into a user's hand.

As most elderly and infirm individuals are all too painfully aware, many blister pack enclosed pills are extremely difficult, if not sometimes impossible, for certain people to open; and, even when opened, these devices have no effective way of conveniently delivering the pill into the user's hand.

As a consequence of the foregoing situation, there has existed a longstanding need among the elderly and the infirm for a new and improved blister pack rupturing device that both separates the pill from the blister pack and facilitates the delivery of the released pill to the user's hand, and the provision of such an arrangement is the stated objective of the present invention.

BRIEF SUMMARY OF THE INVENTION

Briefly stated, the blister pack rupturing device that forms the basis of the present invention comprises in general a multi-tiered housing member having a spring loaded plunger member and a removable trough member.

As will be explained in greater detail further on in the specification, the multi-tiered housing member having a generally E-shaped configuration wherein an upper, an intermediate, and a lower tier are disposed in a cantilevered fashion from a common enlarged vertical spine.

In addition, both the upper and intermediate tiers are provided with aligned apertures dimensioned to reciprocatingly receive a portion of the spring loaded plunger unit to liberate a pill from a blister pack in a relatively well known fashion.

The heart of the invention, however, resides in the provision of a transverse recess formed in the lowest tier of the housing member which is dimensioned to receive an elongated open ended trough member having a recessed central portion that is designed to capture a liberated pill wherein, the user will tilt the housing member using the enlarged handle of the plunger unit to deliver the pill into the user's free hand from either the right hand or left hand side of the device.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
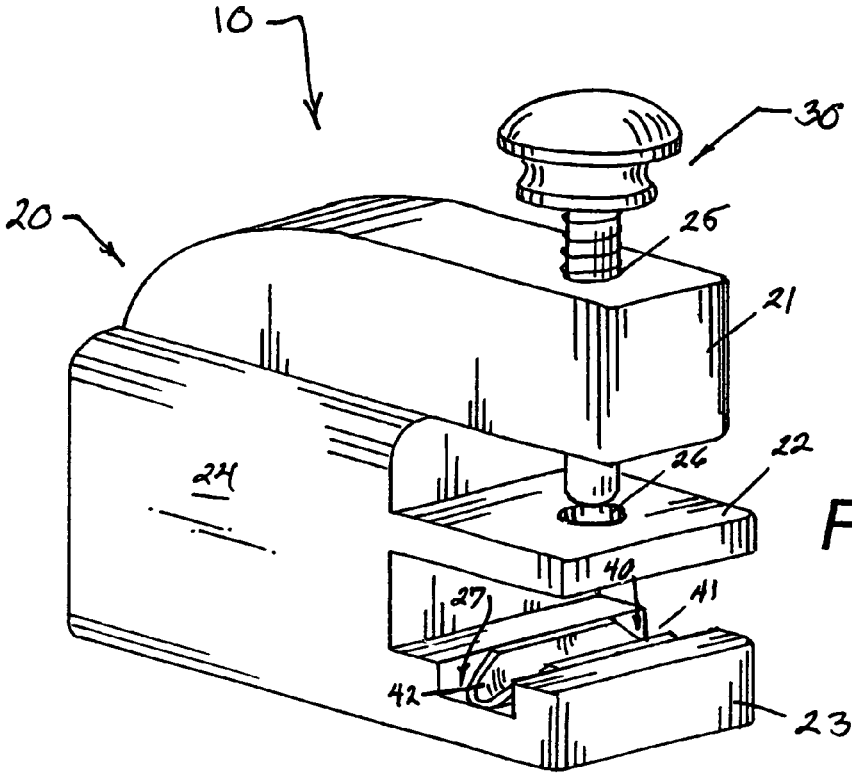
FIG. 1 is a perspective view of the blister pack rupturing device that forms the basis of the present invention.

As can be seen by reference to the drawings, and in particular to FIG. 1, the blister pack rupturing device that forms the basis of the present invention is designated generally by the reference number 10. The device 10 comprises a housing member 20, a plunger member 30, and an elongated trough member 40. These structural components will now be described in seriatim fashion.

As can best be seen by reference to FIG. 1, the multi-tiered housing member 20 has a generally E-shaped configuration wherein, an upper 21, an intermediate 22, and a lower 23 tier are disposed in a generally cantilevered fashion relative to an enlarged vertical spine 24.

In addition, the upper 21 and intermediate 22 tiers are provided with aligned apertures 25 and 26 and the lower tier 24 is provided with a transverse recess 27 the purposes and functions of which will be described presently.

Figure 2:
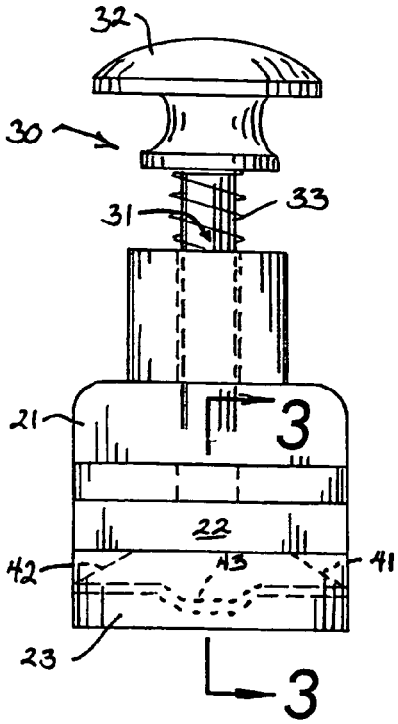
FIG. 2 is a front plan view of the device.
Figure 3:
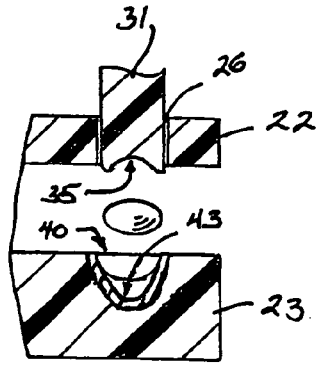
FIG. 3 is a cross-sectional view taken through line 3—3 of FIG. 2.
Figure 4:
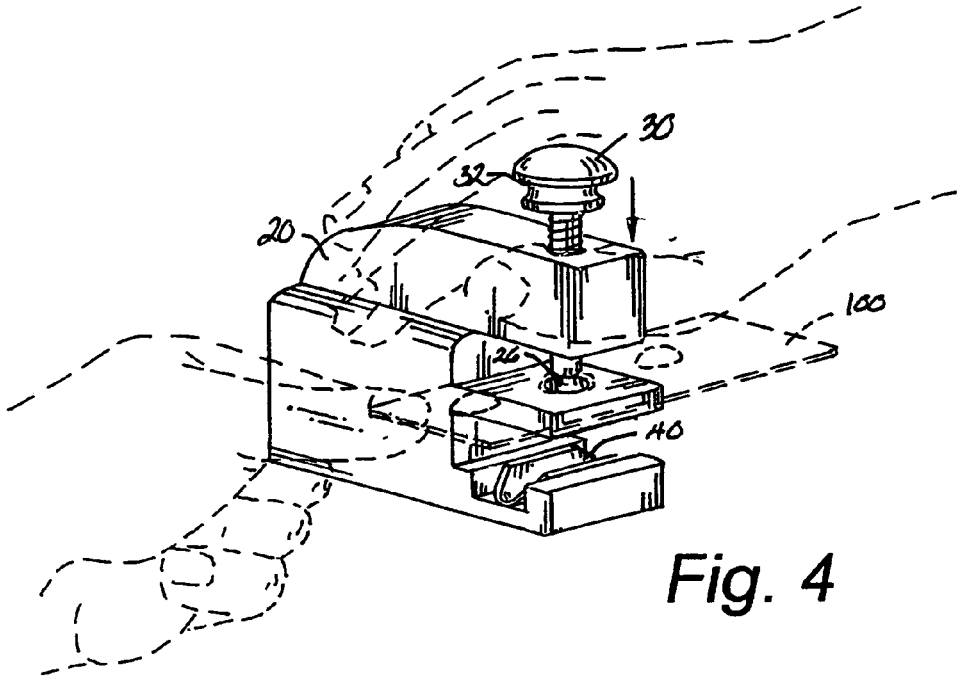
FIG. 4 shows a blister pack inserted into the device.
Figure 5:
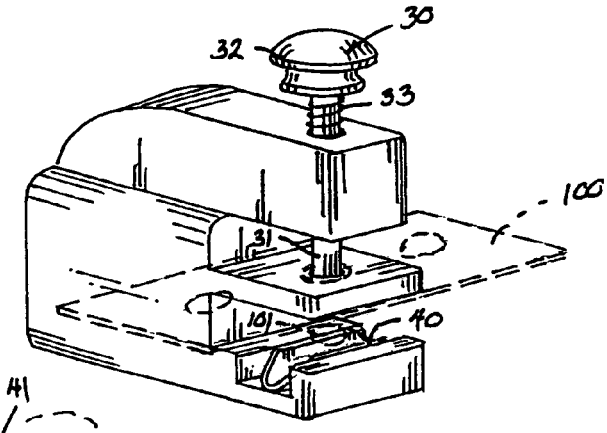
FIG. 5 shows the plunger rod releasing a pill from a blister capsule.
Figure 6:
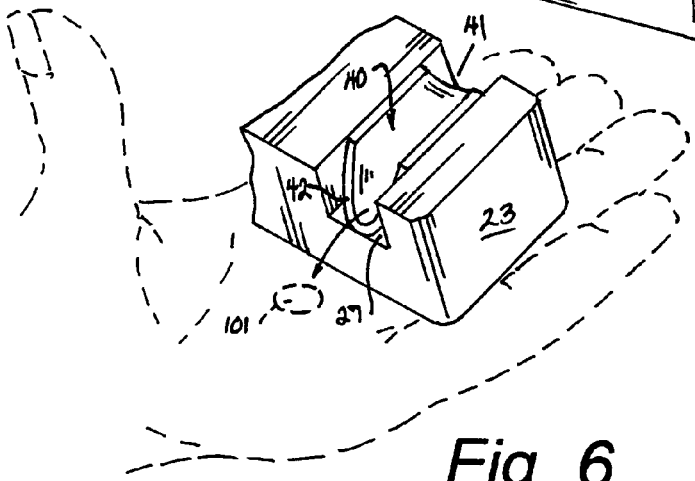
FIG. 6 shows the side delivery of the released pill.

As can also be seen by reference to FIGS. 1 through 3, the plunger member 30 comprises an elongated plunger shaft 31 dimensioned to be slidably received in the aligned apertures 25 26 wherein, the upper portion of the shaft 31 is surrounded by a spring biasing element 33 and terminates in an enlarged plunger handle 32. Furthermore, the bottom of the spring element 33 rests on the top of the upper tier 21 of the housing member 20 and bears against the bottom of the plunger handle 32 to normally raise the concave bottom 35 of the plunger shaft 31 above the top of the aperture 26 in the intermediate tier 22 for reasons that will be explained shortly.

Turning now to FIGS. 1 and 3, it can be seen that the transverse recess 27 in the bottom tier 23 of the housing member 20 is dimensioned to receive the elongated trough member 40 having open ends 41 42 and a central recess 43 for temporarily capturing a liberated pill 101 which may be then dispensed through either of the open ends 41 42.

The blister pack rupturing device 10 is operated by first placing a conventional blister pack 100 containing a pill 101 over the aperture 26 on the intermediate tier 22. Then the plunger handle 32 is pressed downwardly against the resistance of the spring element 33 to force the concave bottom 35 of the shaft 31 against the top of the blister pack 100 to force the pill 101 through the bottom of the blister pack 100.

Once the pill 101 is released from the blister pack 100, it will fall through the aperture 26 into the central recess 43 of the trough member 40 whereupon, the user will place their free hand adjacent a selected one of the open ends 41 42 of the trough and the plunger handle 32 will then be tilted to either the right or the left to tilt the housing member 20 in the desired direction so that the pill will slide down the trough member 40 to either the right or left into the user's free hand.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A blister pack rupturing device for releasing a pill from a blister pack wherein, the device comprises a multi-tiered housing member having a generally E-shaped configuration which includes an upper tier, an intermediate tier and a bottom tier wherein the upper and intermediate tiers are provided with aligned apertures a plunger member having an enlarged plunger handle provided with an elongated plunger shaft which is dimensioned to be slidably received in the aligned apertures in the top and intermediate tiers of the housing member; and, means associated with the bottom tier of the housing member for receiving a pill delivered by gravity through the aperture in the intermediate tier of the housing.

2. The device as in claim 1; wherein, the plunger member is further provided with a spring biasing element that normally positions the bottom of the plunger shaft above the aperture in the intermediate tier of the housing.

3. The device as in claim 2; wherein, said spring biasing-element is disposed in a surrounding relationship relative to the plunger shaft.

4. The device as in claim 3; wherein, one end of the spring biasing element rests on the top of said upper tier and the other end of the spring biasing element contacts the bottom of said handle element.

5. The device as in claim 1; wherein, the bottom of the plunger shaft is concave.

6. The device as in claim 2; wherein, the bottom of the plunger shaft is concave.

7. The device as in claim 3; wherein, the bottom of the plunger shaft is concave.

8. The device as in claim 4; wherein, the bottom of the plunger shaft is concave.

9. The device as in claim 1; wherein, said means comprises at least in part a transverse recess formed in the lower tier of the housing member.

10. The device as in claim 9; wherein, said means comprises a trough member dimensioned to be received in said transverse recess.

11. The device as in claim 10; wherein, said trough member has a pair of opposed open ends.

12. The device as in claim 10; wherein, said trough member is further provided with a central recess.

* * * * *